US009608412B2

(12) United States Patent
Hartmann et al.

(10) Patent No.: US 9,608,412 B2
(45) Date of Patent: Mar. 28, 2017

(54) SPARK PLUG HAVING LONG SERVICE LIFE

(71) Applicant: Robert Bosch GmbH, Stuttgart (DE)

(72) Inventors: Detlef Hartmann, Bamberg (DE); Andreas Benz, Bamberg (DE); Mario Fleischhauer, Poedeldorf (DE); Jochen Fischer, Bamberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 299 days.

(21) Appl. No.: 14/294,453

(22) Filed: Jun. 3, 2014

(65) Prior Publication Data

US 2014/0285083 A1 Sep. 25, 2014

Related U.S. Application Data

(62) Division of application No. 12/734,468, filed as application No. PCT/EP2008/063645 on Oct. 10, 2008, now abandoned.

(30) Foreign Application Priority Data

Nov. 9, 2007 (DE) ..... 10 2007 053 428

(51) Int. Cl.
*H01T 13/32* (2006.01)
*H01T 13/24* (2006.01)
(Continued)

(52) U.S. Cl.
CPC ..... *H01T 13/32* (2013.01); *H01T 13/22* (2013.01); *H01T 13/24* (2013.01); *H01T 13/467* (2013.01);
(Continued)

(58) Field of Classification Search
CPC ..... H01T 21/00; H01T 21/02; H01T 21/06; H01T 13/56
(Continued)

(56) References Cited

U.S. PATENT DOCUMENTS 2,118,251 A * 5/1938 Koehler ..... H01T 13/32 123/169 EB
2,208,059 A * 7/1940 Stahr ..... H01T 13/462 174/167
(Continued)

FOREIGN PATENT DOCUMENTS

DE 37 36 349 4/1988
EP 0 569 787 11/1993
(Continued)

OTHER PUBLICATIONS

International Search Report for PCT/EP2008/063645, dated Jan. 22, 2009.

*Primary Examiner* — Stephen K Cronin
*Assistant Examiner* — Kevin R Steckbauer
(74) *Attorney, Agent, or Firm* — Gerard Messina

(57) ABSTRACT

A spark plug, including a central electrode, a first ground electrode, which is situated in a curved shape having a horizontal area and an essentially vertical area, and at least one second ground electrode, which is situated adjacent to the central electrode in such a way that a distance between the first ground electrode and the central electrode is less than a distance between the second ground electrode and the central electrode.

15 Claims, 5 Drawing Sheets

(51) Int. Cl.

| | |
|---|---|
| ***H01T 13/22*** | (2006.01) |
| *H01T 21/06* | (2006.01) |
| *H01T 21/02* | (2006.01) |
| *H01T 21/00* | (2006.01) |
| *H01T 13/56* | (2006.01) |
| *H01T 13/46* | (2006.01) |

(52) U.S. Cl.
CPC ..... *H01T 13/46* (2013.01); *H01T 13/56* (2013.01); *H01T 21/00* (2013.01); *H01T 21/02* (2013.01); *H01T 21/06* (2013.01)

(58) Field of Classification Search
USPC ..... 123/169 EB, 169 EC, 169 EL, 169 EA, 123/169 MG, 310; 313/122, 125
See application file for complete search history.

(56) References Cited

U.S. PATENT DOCUMENTS

| | | | | |
|---|---|---|---|---|
| 3,870,918 | A | 3/1975 | Senda et al. | |
| 4,196,409 | A * | 4/1980 | Juba | H01R 13/68 337/198 |
| 4,851,732 | A | 7/1989 | Kashiwara et al. | |
| 5,693,999 | A | 12/1997 | Osamura et al. | |
| 5,751,096 | A | 5/1998 | Lahens | |
| 5,797,383 | A | 8/1998 | Matsubara et al. | |
| 5,929,556 | A | 7/1999 | Matsubara et al. | |
| 5,955,827 | A * | 9/1999 | Short | H01T 13/14 313/122 |
| 6,589,091 | B2 * | 7/2003 | Harada | H01T 13/32 445/7 |
| 6,796,299 | B2 * | 9/2004 | Isono | H01T 13/467 123/169 EL |
| 2002/0094743 | A1 * | 7/2002 | Harada | H01T 13/32 445/7 |
| 2003/0178925 | A1 * | 9/2003 | Kumagai | H01T 13/39 313/141 |
| 2004/0112351 | A1 * | 6/2004 | Isono | H01T 13/467 123/627 |
| 2005/0264153 | A1 | 12/2005 | Hanashi | |
| 2006/0055298 | A1 | 3/2006 | Kanao | |
| 2010/0319656 | A1 | 12/2010 | Clarke | |
| 2010/0320894 | A1 * | 12/2010 | Hartmann | H01T 13/467 313/142 |
| 2014/0285083 | A1 * | 9/2014 | Hartmann | H01T 13/32 313/141 |

FOREIGN PATENT DOCUMENTS

| | | | |
|---|---|---|---|
| JP | 0311575 A * | 1/1991 | H01T 21/02 |
| JP | 3011249 | 12/1993 | |
| JP | 2003-257585 | 9/2003 | |

* cited by examiner

SPARK PLUG HAVING LONG SERVICE LIFE

CROSS-REFERENCE TO RELATED APPLICATIONS

The present application is a divisional application of U.S. patent application Ser. No. 12/734,468, filed Sep. 2, 2010, which is a national phase to International Application No. PCT/EP2008/063645, filed Oct. 10, 2008, and claims priority to German Patent Application No. 10 2007 053 428.2, filed Nov. 9, 2007, all of which are hereby incorporated by reference in their entireties.

FIELD OF THE INVENTION

The present invention relates to a spark plug, which has a particularly long service life and is usable in particular for stationary engines, such as gas engines.

BACKGROUND INFORMATION

There are spark plugs from the related art in various designs. The spark plugs from the automobile field may have a central electrode and a ground electrode. Spark plugs of this type are mass-produced parts, which may typically have a service life of 100,000 km or more. This is achieved, for example, in that noble metals having improved corrosion and erosion properties are used as the electrode wear surface. In the case of stationary internal combustion engines, which are typically operated using combustible gases, such as natural gas, sewage gas, landfill gas, biogas, or hydrogen, the spark plug service life is approximately 2,000 operating hours. In particular in turbocharged stationary internal combustion engines, these run times are only achieved with difficulty using the known spark plugs from the motor vehicle application. Gas engines typically have a higher compression and therefore react significantly more sensitively to an increase in the distance of the electrode, which continuously increases during operation due to electrode wear. Because stationary engines are frequently also used in continuous operation, spark plug change is necessary after only approximately 90 days.

A spark plug from U.S. Pat. No. 5,751,096 B1 has one central electrode and two diametrically opposing ground electrodes. The ground electrodes are situated diametrically opposite one another in a vertical orientation in the longitudinal direction of the spark plug, parallel to the central electrode. As a result of the two ground electrodes, a relatively large ignition range may be ensured on the spark plug, in particular by two electrode gaps.

Furthermore, a spark plug from EP 0 569 787 A1 has a central electrode, a ground electrode, and an intermediate electrode. The intermediate electrode is situated in an area between the central electrode and the ground electrode, the intermediate electrode forming a separate electrode gap with both the central electrode and the ground electrode. Two ignition sparks, namely one ignition spark per electrode gap, may be generated in this way.

SUMMARY OF THE INVENTION

The spark plug according to the present invention having the features described herein has the advantage in relation thereto that the spark plug has a significantly longer service life. According to the present invention, the operating life may be significantly increased by the use of at least two ground electrodes, which are used one after another during operation. After the first ground electrode is worn, the second ground electrode is used. It may be brought into use in a simple way, for example, by bending toward the central electrode, because the second ground electrode is located already prepared on the spark plug. In order to prevent both ground electrodes from being used simultaneously during operation, a distance between the first ground electrode and the central electrode is less than a distance between the second ground electrode and the central electrode. The sparks are thus always generated between the first ground electrode and the central electrode during operation. When the first ground electrode is worn, it is bent away or removed and the second ground electrode is bent in, so that the ignition spark is then generated between the second ground electrode and the central electrode. The spark plug according to the present invention is thus suitable in particular for use in stationary internal combustion engines.

The further descriptions herein provide further exemplary embodiments of the present invention.

The first ground electrode having a curved shape may be situated over the central electrode. The first ground electrode thus forms a top ground electrode. Alternatively, the first ground electrode is an electrode situated adjacent to the central electrode, so that it forms a laterally placed ground electrode. A spark between the ground electrode and the central electrode is thus generated in a plane perpendicular to the longitudinal direction of the spark plug.

In order to provide the most compact and simplest construction possible, the second ground electrode of the spark plug may be situated vertically parallel to the central electrode. Thus, as soon as the first ground electrode is worn out, the second ground electrode can be put into operation by simply bending it over by 90° toward the central electrode. Therefore, only one simple bending step is necessary, which may be executed easily using a gauge, so that an optimum distance between the second ground electrode and central electrode may be set rapidly.

According to an alternative embodiment of the present invention, the second ground electrode is situated in such a way that it is slightly pre-bent toward the central electrode. A bending procedure of the second ground electrode when it is to be used is thus significantly simplified. The second ground electrode may be pre-bent at a pre-bent angle of approximately 20° relative to the vertical orientation of the central electrode.

Starting from a fastening area of the ground electrode on the spark plug, a length of the second ground electrode may be shorter than a length of the first ground electrode. Through this design, a simple adaptation of the second ground electrode to a wear-related shortening of the central electrode may be executed during operation. The first ground electrode is first worn and a length of the central electrode is also shortened during operation. When the second ground electrode is to be used instead of the first ground electrode, optimum adaptation to the wear-related shortened central electrode is possible through the previously provided shortening of the second ground electrode. The shortened length of the second ground electrode is selected in such a way that, for example, an average shortening of the central electrode is determined on the basis of average values, which the central electrode has after complete wear of the first ground electrode, so that the second ground electrode may then accordingly be bent over optimally toward the central electrode. This shortened second ground electrode may particularly be used in the case of top ground electrodes. Moreover, the spark plug may further include at least one third ground electrode, a length of the second ground electrode starting from a base area of the second ground electrode up to the free end of the ground electrode being greater than a length of the third ground electrode.

According to an alternative embodiment of the present invention, the first ground electrode and the second ground electrode each have a noble metal area. The noble metal area of the first ground electrode may be situated at a different position in the longitudinal direction of the ground electrode than a noble metal area on the second ground electrode. After the first ground electrode is worn, the second ground electrode may thus be bent away in a similar way as in the case of ground electrodes having different lengths, the noble metal area then being situated at a position on the second ground electrode so that it comes into an optimum position with respect to the already worn central electrode after the bending procedure.

The spark plug particularly may include precisely three or precisely four ground electrodes. A usage period of the spark plug may thus be increased further. Whenever a ground electrode is worn, it is, for example, snapped off or bent away and a next ground electrode is bent into a corresponding position toward the central electrode. A very long service life may thus be achieved for the spark plug. The plurality of ground electrodes may be situated at equal intervals along a periphery of the spark plug, i.e., with three ground electrodes, they are each situated at an angle of 120°, and with four ground electrodes, they are each situated at an angle of 90°.

Furthermore, the present invention relates to a stationary internal combustion engine having a spark plug according to the present invention. The stationary internal combustion engine may be a stationary gas engine in particular, which is operated using a gas as the fuel, such as natural gas, sewage gas, landfill gas, biogas, or hydrogen. Through the idea according to the present invention of providing multiple ground electrodes on the spark plug, which can be used one after another, a first ground electrode may simply be removed or bent away after it is worn and a second ground electrode may be bent over into an optimum orientation with respect to the central electrode. Optimum orientation of the second ground electrode may also be made possible in particular in consideration of the wear possibly present on the central electrode.

Alternatively, the spark plug may also be used in large engines for trucks, buses, construction machinery, or ships.

Exemplary embodiments of the present invention are described in greater detail hereafter with reference to the appended drawings.

DETAILED DESCRIPTION

Figure 1:
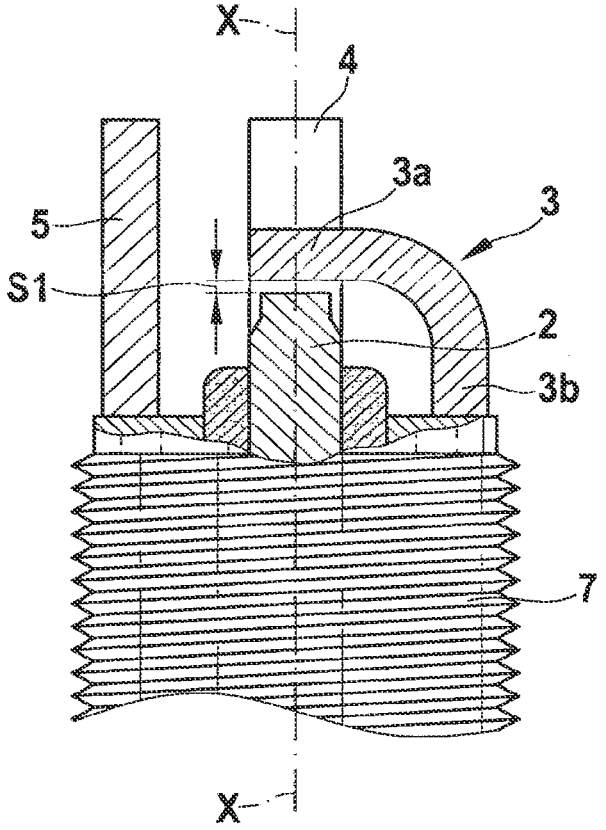
FIG. 1 shows a schematic sectional view of a spark plug according to a first exemplary embodiment of the present invention.
Figure 2:
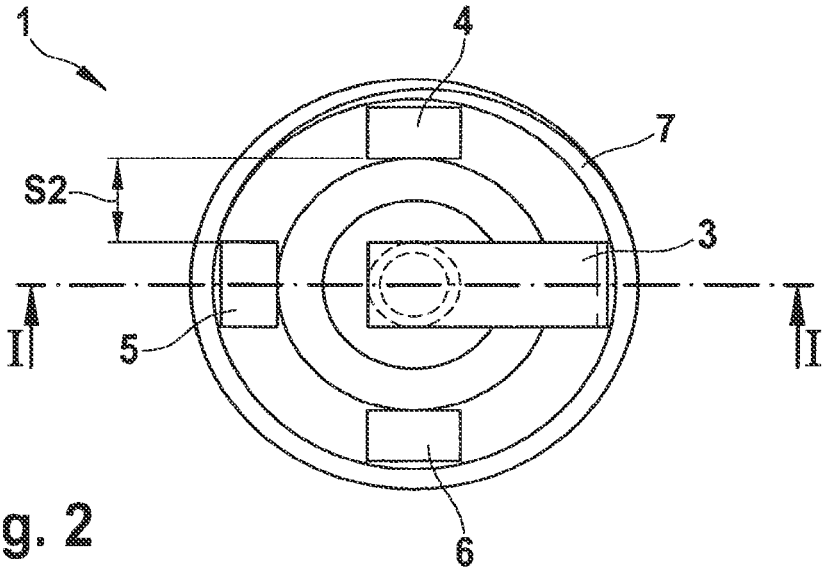
FIG. 2 shows a schematic top view of the spark plug shown in FIG. 1.

A spark plug 1 according to a first exemplary embodiment of the present invention is described in greater detail hereafter with reference to FIGS. 1 and 2, FIG. 1 being a section along line I-I of FIG. 2.

As shown in FIG. 1, spark plug 1 includes a central electrode 2, which is situated centrally in the spark plug and protrudes from a housing 7. Furthermore, spark plug 1 of the first exemplary embodiment includes four ground electrodes, namely a first ground electrode 3, a second ground electrode 4, a third ground electrode 5, and a fourth ground electrode 6 (cf. FIG. 2). The four ground electrodes are each situated along the periphery of the spark plug at an angle of 90° to an adjacent ground electrode. As shown in FIGS. 1 and 2, only first ground electrode 3 is active during operation in the illustrated state of spark plug 1. First ground electrode 3 is bent over by 90° into a curved shape for this purpose, so that it has a horizontal area 3*a* and a vertical area 3*b*, which are connected to one another via a curved area. First ground electrode 3 is situated in such a way with respect to central electrode 2 that a gap S1 is provided between them, and first ground electrode 3 is situated above central electrode 2 (cf. FIG. 2). First ground electrode 3 is thus a so-called top ground electrode, so that the ignition spark arises between first ground electrode 3 and central electrode 2 in gap S1. Three other ground electrodes 4, 5, 6 are situated vertically on the spark plug parallel to central electrode 2 corresponding to a longitudinal direction X-X of the spark plug. A distance of three other ground electrodes 4, 5, 6 is greater than distance S1 between first ground electrode 3 and central electrode 2. A distance between second ground electrode 4 and central electrode 2 is schematically shown in FIG. 2 and identified by S2. Because the four ground electrodes are connected to one another in the interior of housing 7, the greater distance of currently inactive ground electrodes 4, 5, 6 ensures that no sparks are generated between these ground electrodes and central electrode 2.

When first ground electrode 3 is worn after a specific operating time, the spark plug is removed from the engine and first ground electrode 3 is pinched off or separated in another way in vertical area 3*b*, for example. Subsequently, second ground electrode 4 is bent over by 90° at its free end, so that it forms a new top ground electrode for central electrode 2. Because wear may also occur on central electrode 2 during operation, second ground electrode 4 may be bent over somewhat further in the axial direction in the direction of housing 7, so that an optimum distance is established between central electrode 2 and second ground electrode 4. A gauge, inter alia, may also be used for the bending-over procedure. When second ground electrode 4 is worn during further operation, it is also removed and instead third ground electrode 5 is bent over, and when third ground electrode 5 is worn after further operating hours, it is removed and fourth ground electrode 6 is bent over. Spark plug 1 according to the present invention of the first exemplary embodiment therefore has a service life that is approximately four times as long as that of a typical spark plug used until now having only one ground electrode. Because ground electrodes 4, 5, 6 which are held in reserve are each bent over immediately before their use, optimum orientation of the newly bent-over ground electrode may also be ensured, so that the spark plug is able to provide optimum power density.

Ground electrodes 3, 4, 5, 6 and central electrode 2 may be provided in the form of noble metal pins or a base pin having an attached noble metal pin. For example, platinum, iridium, rhodium, ruthenium, or palladium, or arbitrary combinations and/or alloys of these noble metals may be used as the noble metal. The wear behavior may be improved further by the use of the noble metal. For example, an alloy having nickel as the main component may be used as the electrode base material. Alternatively, ground electrodes 3, 4, 5, 6 and central electrode 2 may also be equipped with laminas made of noble metal, the noble metal laminas being situated on the free end of central electrode 2 or the area of the ground electrodes which points directly toward central electrode 2 in the bent-over state. The noble metal laminas on the central electrode and the ground electrode in use are thus directly diametrically opposite one another.

Figure 3:
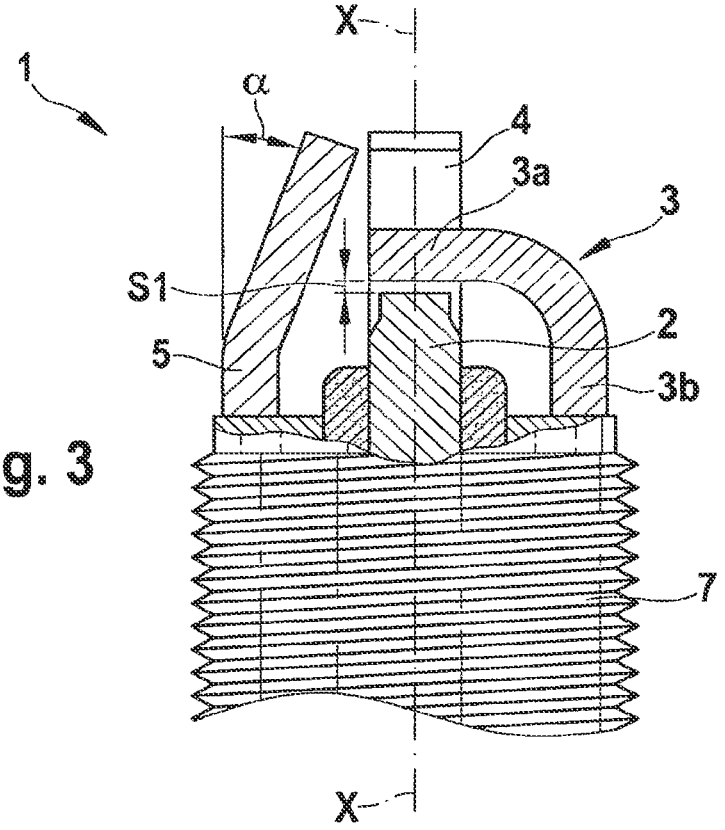
FIG. 3 shows a partially cutaway view of a spark plug according to a second exemplary embodiment of the present invention.
Figure 4:
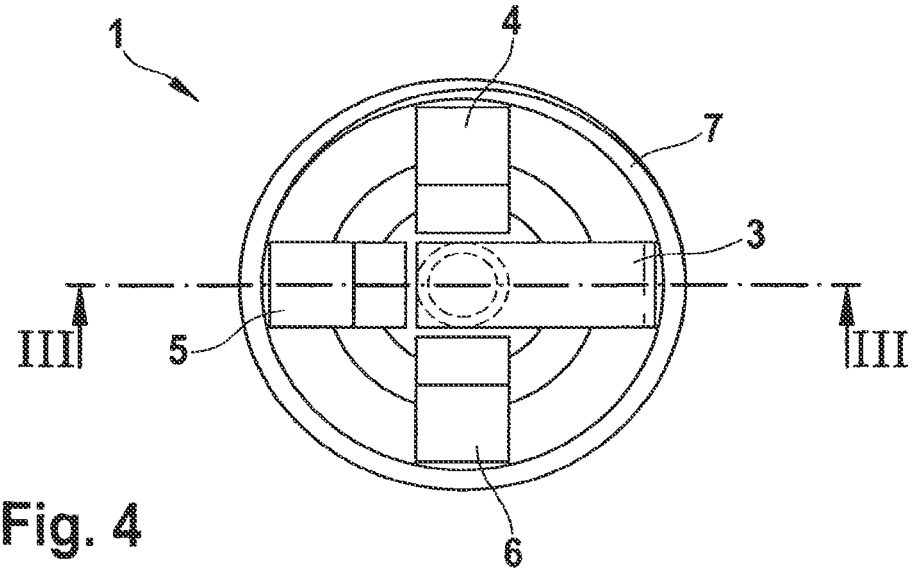
FIG. 4 shows a top view of a spark plug according to a second exemplary embodiment of the present invention.

A spark plug 1 according to a second exemplary embodiment of the present invention is described in greater detail hereafter with reference to FIGS. 3 and 4. Identical or functionally identical parts are identified by identical reference numerals as in the first exemplary embodiment.

Spark plug 1 of the second exemplary embodiment essentially corresponds to that of the first exemplary embodiment, with the exception of ground electrodes 4, 5, 6 which are held in reserve being pre-bent by a predetermined angle $\alpha$. Angle $\alpha$ is approximately 20°. As shown in the sectional view of FIG. 3 along line III-III of FIG. 4, reserve ground electrodes 4, 5, 6 are pre-bent inward in the direction of central electrode 2. The bending procedure after wear of one of the ground electrodes and the then used ground electrode may thus be executed more easily. Otherwise, this exemplary embodiment corresponds to the preceding exemplary embodiment, so that reference may be made to the description given there.

Figure 5:
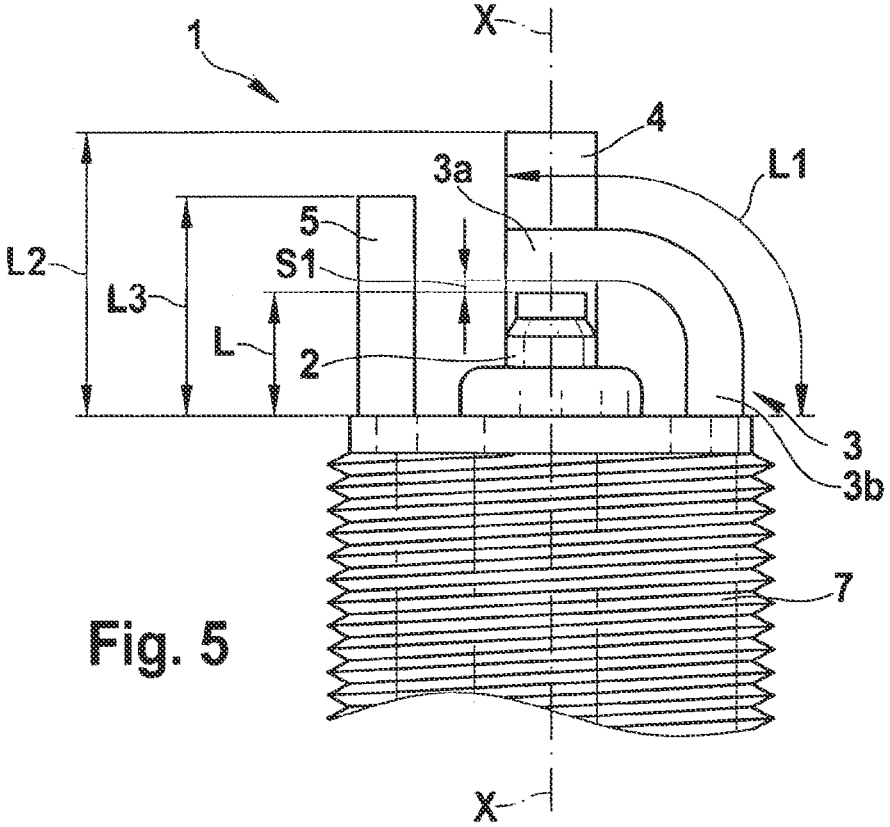
FIG. 5 shows a side view of a spark plug according to a third exemplary embodiment of the present invention.
Figure 6:
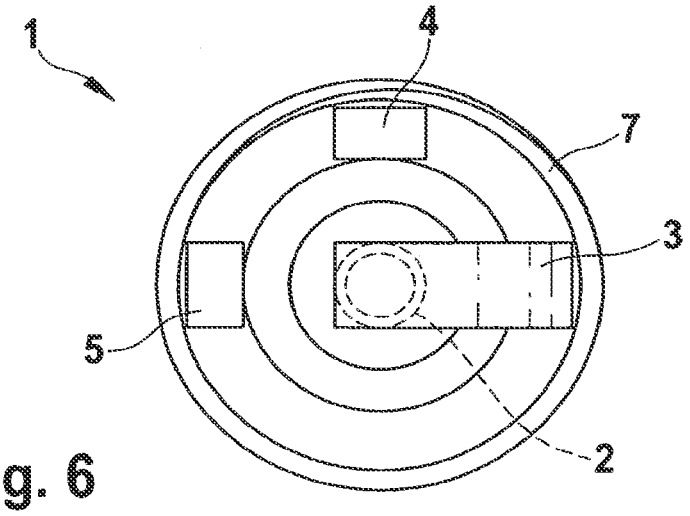
FIG. 6 shows a top view of a spark plug according to a third exemplary embodiment of the present invention.

A spark plug 1 according to a third exemplary embodiment of the present invention is described in greater detail hereafter with reference to FIGS. 5 and 6. Identical or functionally identical parts are again identified by identical reference numerals as in the preceding exemplary embodiment.

In contrast to the preceding exemplary embodiments, spark plug 1 of the third exemplary embodiment only has a total of three ground electrodes, namely a first ground electrode 3, a second ground electrode 4, and a third ground electrode 5 (cf. FIG. 6). Furthermore, as shown in FIG. 5 in particular, a length of the three ground electrodes varies starting from the free end of the ground electrodes up to a fastening area, at which they are fastened on housing 7 of the spark plug. More precisely, first ground electrode 3 has a length L1, which is greater than a length L2 of second ground electrode 4, and length L2 of second ground electrode 4 being greater than a length L3 of third ground electrode 5. Length L1 of first ground electrode 3 is thus greater than length L2 of second ground electrode 4, which is in turn greater than length L3 of third ground electrode 5. Through this measure, it is possible that, because wear also occurs on central electrode 2 during operation so that protruding length L of central electrode 2 becomes shorter, second ground electrode 4, which is used after wear of first ground electrode 3, may be bent precisely over central electrode 2 due to its shorter length L2. Length L2 is shortened in relation to length L1 of first ground electrode 3 in such a way that the wear of central electrode 2 was also incorporated precisely, so that second ground electrode 4 lies optimally above central electrode 2. Accordingly, when second ground electrode 4 is also worn, third ground electrode 5 is bent over, central electrode 2 being worn still further, so that the shorter third ground electrode also optimally fits over central electrode 2. Otherwise, this exemplary embodiment corresponds to the preceding exemplary embodiment, so that reference may be made to the description given there.

Figure 7:
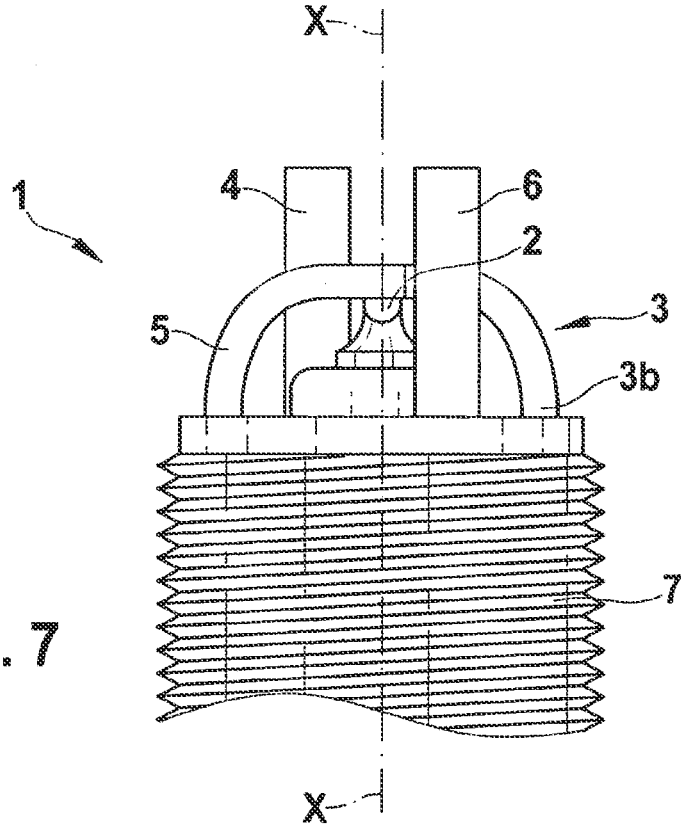
FIG. 7 shows a side view of a spark plug according to a fourth exemplary embodiment of the present invention.
Figure 8:
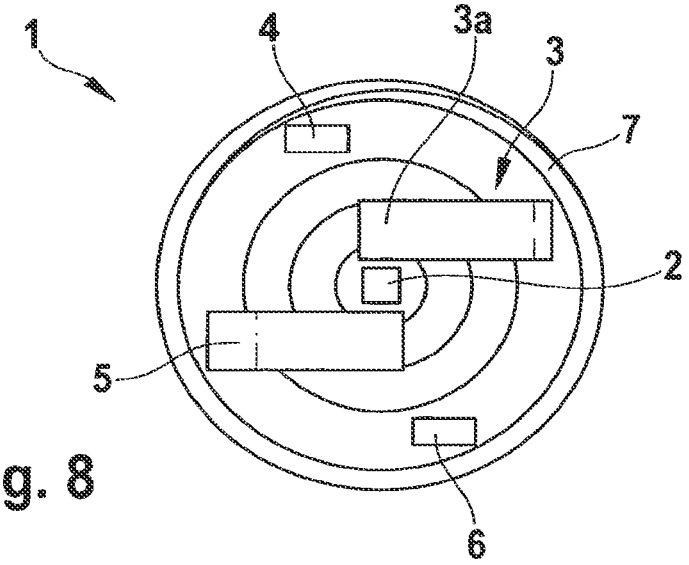
FIG. 8 shows a top view of a spark plug according to a fourth exemplary embodiment of the present invention.

A spark plug 1 according to a fourth exemplary embodiment of the present invention is described in greater detail hereafter with reference to FIGS. 7 and 8. Identical or functionally identical parts are again identified by identical reference numerals as in the preceding exemplary embodiments.

As shown in FIG. 8 in particular, the spark plug of the fourth exemplary embodiment includes a so-called laterally placed electrode instead of a top electrode. In the fourth exemplary embodiment, first ground electrode 3 and third ground electrode 5 are laterally placed simultaneously, so that sparking is possible between the central electrode and first and third ground electrodes 3, 5. Furthermore, as shown in FIG. 8, second ground electrode 4 and fourth ground electrode 5 are kept in reserve and protrude vertically from spark plug 1, and they are situated parallel to central electrode 2. When first ground electrode 3 and third ground electrode 5 are worn, second ground electrode 4 and fourth ground electrode 6 are bent over and replace the worn ground electrodes, so that the total service life of the spark plug may be lengthened, as described in the preceding exemplary embodiment. The laterally placed ground electrodes have the advantage that in particular the bending-over procedure may be performed more easily, because the free end of the ground electrodes may be gripped readily using a tool and the reshaping procedure may be performed. It is to be noted in this case that spark plug 1 according to the fourth exemplary embodiment may also be designed in such a way that only one of the ground electrodes is bent over and is used during operation. The use of two active ground electrodes 3, 5 simultaneously, as shown in FIGS. 7 and 8, has the advantage that a spark may be generated both in the gap between central electrode 2 and first ground electrode 3 and in the gap between central electrode 2 and third ground electrode 5. Even more reliable ignition of a combustible mixture may thus be achieved in particular. Otherwise, this exemplary embodiment corresponds to the preceding exemplary embodiments, so that reference may be made to the description given therein.

Figure 9:
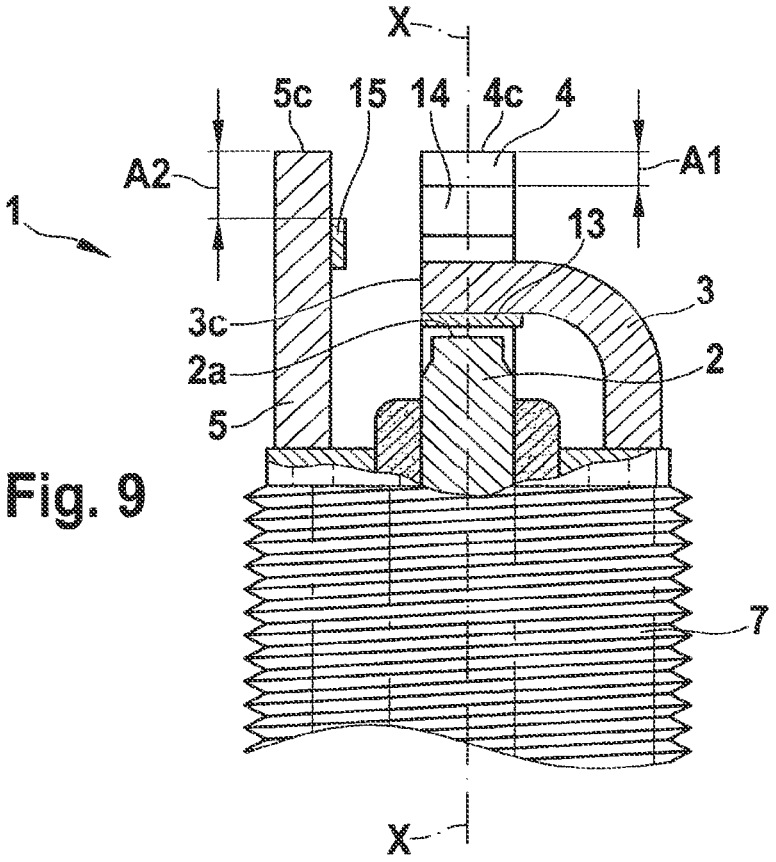
FIG. 9 shows a partially cutaway view of a spark plug according to a fifth exemplary embodiment of the present invention.
Figure 10:
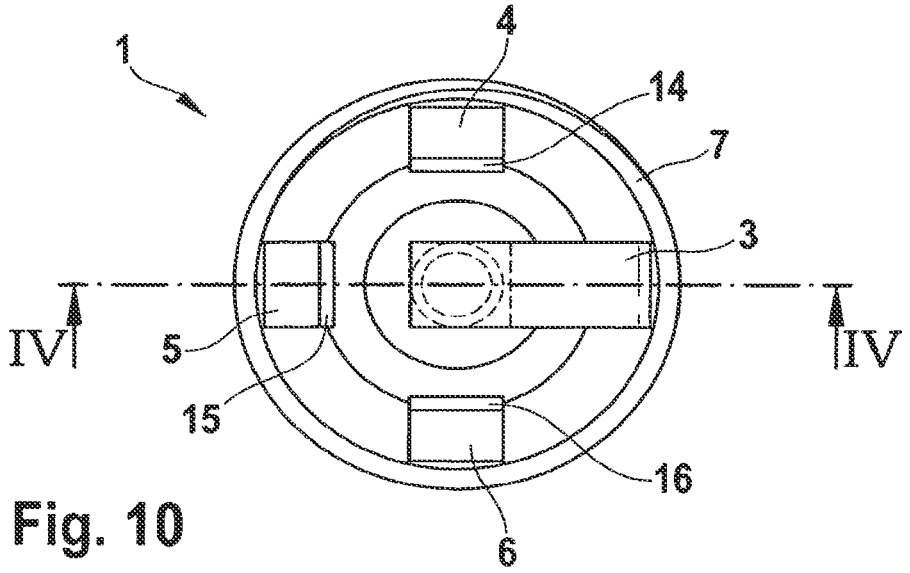
FIG. 10 shows a top view of a spark plug according to a fifth exemplary embodiment of the present invention.

FIGS. 9 and 10 show a spark plug 1 according to a fifth exemplary embodiment of the present invention. Identical or functionally identical parts are again identified by identical reference numerals as in the preceding exemplary embodiments.

As shown in particular in the sectional view of FIG. 9, which is a section along line IX-IX of FIG. 10, spark plug 1 of the fifth exemplary embodiment essentially corresponds to that of the first exemplary embodiment. In contrast thereto, noble metal laminas 13, 14, 15, 16 are additionally also provided on ground electrodes 3, 4, 5, 6. The noble metal laminas improve the wear resistance of the ground electrodes, the ground electrodes being able to have a base pin manufactured from a cost-effective material. The base pins all have the same fundamental length. As shown in FIG.

9 in particular, the noble metal laminas are situated at different positions on ground electrodes 3, 4, 5, and 6. More precisely, noble metal lamina 13 of first ground electrode 3 is situated directly on free end 3*c* of first ground electrode 3. Noble metal lamina 14 of second ground electrode 4 is situated in such a way that there is a distance A1 from free end 4*c* of second ground electrode 4. Noble metal lamina 15 of third ground electrode 5 is situated in such a way that there is a distance A2 from free end 5*c* of third ground electrode 5. Distance A2 is greater than distance A1. Fourth noble metal lamina 16 is also situated in such a way that there is a distance (not shown in FIGS. 9 and 10) from free end 6*c* of fourth ground electrode 6, the distance at the fourth ground electrode being greater than distance A2 at the third ground electrode. By situating the noble metal lamina at different positions on ground electrodes 3, 4, 5, 6, which are otherwise equally long, the same function is obtained as in the third exemplary embodiment, namely that wear on central electrode 2 which also occurs during operation may be compensated for better by the varying positioning of the noble metal laminas. Because the noble metal laminas are each situated at different positions, they are selected after the bending-over procedure as the top ground electrode corresponding to the wear of central electrode 2 so that they lie directly diametrically opposite front side 2*a* of central electrode 2 after the bending-over procedure. Otherwise, this exemplary embodiment corresponds to the preceding exemplary embodiments, so that reference may be made to the description given there.

What is claimed is:

1. A method for generating sparks in a spark plug, comprising:

attaching a first ground electrode and a second ground electrode to the spark plug;

positioning the first ground electrode and the second ground electrode at a first distance and a second distance, respectively, from a central electrode, wherein the second distance is greater than the first distance;

generating a spark during operation only between the first ground electrode and the central electrode;

removing the first ground electrode from the spark plug;

repositioning the second ground electrode to the first distance from the central electrode; and generating a spark during operation only between the second ground electrode and the central electrode.

2. The method of claim 1, wherein the second distance between the second ground electrode and the central electrode is such that no sparks are generated.

3. The method of claim 1, wherein the first ground electrode is situated over the central electrode in the bent-over state, so as to form a top ground electrode, or the first ground electrode is situated adjacent to the central electrode in the bent-oyer state, so as to form a laterally placed ground electrode.

4. The method of claim 1, wherein a length of the second ground electrode is less than a length of the first ground electrode.

5. The method of claim 1, wherein a noble metal area is provided on the first ground electrode and a noble metal area is provided on the second ground electrode, starting from a fastening area of the ground electrodes on the spark plug, and wherein the noble metal area of the first ground electrode is situated at a different position in the longitudinal direction of the first ground electrode than the noble metal area of the second ground electrode.

6. The method of claim 1, wherein the spark plug includes a third ground electrode and a fourth ground electrode.

7. The method of claim 1, wherein the plurality of ground electrodes is situated at an equal peripheral distance from one another along a periphery of the spark plug.

8. A method for using a spark plug in an internal combustion engine, the method comprising:

attaching a first ground electrode and a second ground electrode to the spark plug;

positioning the first ground electrode and the second ground electrode at a first distance and a second distance, respectively, from a central electrode, wherein the second distance is greater than the first distance such that during operation sparks are generated only between the first ground electrode and the central electrode;

removing the first ground electrode from the spark plug after operation;

repositioning the second ground electrode to the first distance from the central electrode such that during operation sparks are generated only between the second ground electrode and the central electrode.

9. The method of claim 8, wherein the spark plug includes a third ground electrode and a fourth ground electrode.

10. A method for using a spark plug in a heavy-duty motor vehicle, the method comprising:

attaching a first ground electrode and a second ground electrode to the spark plug;

positioning the first ground electrode and the second ground electrode at a first distance and a second distance, respectively, from a central electrode, wherein the second distance is greater than the first distance such that during operation sparks are generated only between the first ground electrode and the central electrode;

removing the first ground electrode from the spark plug after operation;

repositioning the second ground electrode to the first distance from the central electrode such that during operation sparks are generated only between the second ground electrode and the central electrode.

11. The method of claim 10, wherein the heavy-duty motor vehicle includes one of a truck, a construction machine, a bus, and a ship.

12. The method of claim 10, wherein the spark plug includes a third ground electrode and a fourth ground electrode.

13. The method of claim 12, further comprising:

after operation, removing the second ground electrode from the spark plug;

positioning the third ground electrode to the first distance from the central electrode such that during operation sparks are generated only between the third ground electrode and the central electrode.

14. The method of claim 13, further comprising:

after operation, removing the third ground electrode from the spark plug; and positioning the fourth ground electrode to the first distance from the central electrode such that during operation sparks are generated only between the fourth ground electrode and the central electrode.

15. The method of claim 10, wherein the first ground electrode is removed by pinch force.

* * * * *